US011499452B2

(12) United States Patent
Rotter

(10) Patent No.: US 11,499,452 B2
(45) Date of Patent: Nov. 15, 2022

(54) INTERNAL COMBUSTION ENGINE AND OIL TREATMENT APPARATUS FOR USE WITH THE SAME

(71) Applicant: Kohler Co., Kohler, WI (US)

(72) Inventor: Terrence M. Rotter, Sheboygan, WI (US)

(73) Assignee: KOHLER CO.

( * ) Notice: Subject to any disclaimer, the term of this patent is extended or adjusted under 35 U.S.C. 154(b) by 10 days.

(21) Appl. No.: 17/098,427

(22) Filed: Nov. 15, 2020

(65) Prior Publication Data

US 2021/0062693 A1 Mar. 4, 2021

Related U.S. Application Data

(63) Continuation of application No. 16/416,733, filed on May 20, 2019, now Pat. No. 10,858,971, which is a (Continued)

(51) Int. Cl.
*F01M 1/10* (2006.01)
*F01M 9/06* (2006.01)

(Continued)

(52) U.S. Cl.
CPC ..... *F01M 1/10* (2013.01); *F01M 1/02* (2013.01); *F01M 1/04* (2013.01); *F01M 9/06* (2013.01);

(Continued)

(58) Field of Classification Search
CPC .. F01M 1/10; F01M 1/02; F01M 1/04; F01M 9/06; F01M 11/0004; F01M 11/03;

(Continued)

(56) References Cited

U.S. PATENT DOCUMENTS 2,192,543 A * 3/1940 Dell ..... G01F 23/04 251/291
2,672,984 A * 3/1954 Russell ..... B01D 29/15 210/282

(Continued)

FOREIGN PATENT DOCUMENTS

CN 2608692 3/2004
EP 0459031 12/1991

(Continued)

OTHER PUBLICATIONS

First Office Action in Corresponding CN Application No. 20160664228, dated Jun. 25, 2018.

(Continued)

*Primary Examiner* — Kurt Philip Liethen
(74) *Attorney, Agent, or Firm* — The Belles Group, P.C.

(57) ABSTRACT

An oil treatment system for an internal combustion engine in one implementation includes an elongated dipstick tube defining a tube axis and a first flow passageway, a housing arranged on the dipstick tube and defining an internal cavity, an oil treatment apparatus disposed in the internal cavity, and a retainer coupled to the housing. The retainer may have a cylindrical body comprising an elongated first flow protuberance insertably received through the oil treatment apparatus to establish fluid communication between the oil treatment apparatus and the first flow passageway of the dipstick tube. The retainer comprises a cavity through which oil may be added directly to the first flow passageway of the dipstick which may be fluidly coupled to an oil sump of the engine. The oil treatment apparatus may be an oil filter. An oil treatment additive may optionally be added to the housing.

20 Claims, 10 Drawing Sheets

Related U.S. Application Data continuation of application No. 15/229,733, filed on Aug. 5, 2016, now Pat. No. 10,323,552.

(60) Provisional application No. 62/205,156, filed on Aug. 14, 2015.

(51) Int. Cl.

| | |
|---|---|
| ***F01M 11/00*** | (2006.01) |
| ***F01M 11/12*** | (2006.01) |
| ***F01M 11/03*** | (2006.01) |
| ***F01M 1/02*** | (2006.01) |
| ***F01M 1/04*** | (2006.01) |

(52) U.S. Cl.
CPC ..... *F01M 11/0004* (2013.01); *F01M 11/03* (2013.01); *F01M 11/12* (2013.01)

(58) Field of Classification Search
CPC ..... F01M 11/12; F02B 63/00; F02B 63/02; F02M 35/1017
See application file for complete search history.

(56) References Cited

U.S. PATENT DOCUMENTS

| | | | | |
|---|---|---|---|---|
| 2,919,028 | A * | 12/1959 | Janus | B01D 35/06 73/61.41 |
| 3,152,077 | A | 10/1964 | Kryzer | |
| 3,710,930 | A | 1/1973 | Owdom | |
| 3,926,339 | A * | 12/1975 | Openchowski | B67D 3/00 222/83 |
| 4,151,823 | A | 5/1979 | Grosse | |
| 4,561,395 | A | 12/1985 | McMullen | |
| 4,751,901 | A | 6/1988 | Moor | |
| 5,080,082 | A | 1/1992 | Mueller et al. | |
| 5,209,842 | A | 5/1993 | Moor | |
| 5,209,853 | A | 5/1993 | Lynch et al. | |
| 5,230,795 | A * | 7/1993 | Yang | B01D 27/08 210/236 |
| 5,421,223 | A * | 6/1995 | Wawrzyniak | B25B 27/0042 210/238 |
| 5,694,990 | A * | 12/1997 | Crima | B09B 2101/02 141/330 |
| 5,753,116 | A | 5/1998 | Baumann | |
| 6,056,874 | A * | 5/2000 | Goodman | F16N 31/002 137/312 |
| 6,138,722 | A | 10/2000 | Willingham | |
| 6,279,247 | B1 | 8/2001 | Neitzel | |
| 6,585,887 | B2 * | 7/2003 | Michels | B01D 27/106 210/130 |
| 6,616,838 | B1 | 9/2003 | Harris | |
| 6,681,737 | B2 | 1/2004 | Shinoda et al. | |
| 7,018,531 | B2 | 3/2006 | Eilers et al. | |
| 7,704,397 | B2 * | 4/2010 | Meddock | B01D 35/1576 210/338 |
| 2004/0011318 | A1 * | 1/2004 | Bonde | F02B 75/007 123/195 R |
| 2005/0061734 | A1 | 3/2005 | Tarrant | |
| 2008/0078716 | A1 | 4/2008 | Farmer | |
| 2010/0043734 | A1 | 2/2010 | Holzmann et al. | |
| 2011/0041796 | A1 | 2/2011 | Sachdev | |
| 2011/0253102 | A1 | 10/2011 | Watanabe | |
| 2012/0097482 | A1 | 4/2012 | Miller et al. | |
| 2014/0026844 | A1 | 1/2014 | Yamashiro | |
| 2017/0044938 | A1 | 2/2017 | Rotter | |
| 2018/0135477 | A1 * | 5/2018 | Hellman | F01M 1/12 |

FOREIGN PATENT DOCUMENTS

| | | |
|---|---|---|
| GB | 590618 | 7/1947 |
| JP | S55-117015 | 9/1980 |

OTHER PUBLICATIONS

SecondOffice Action in Corresponding CN Application No. 201610664228, dated Jan. 10, 2019.

Smolensk!, Don Dr., "Component Performance in Engine Oil Formulation", *Society of Tribologists and Lubrication Engineers*, Oct. 2013 issue of TLT, pp. 1-7.

European Extended Search Report for related EU Application No. 16183721.6, dated Jan. 26, 2017.

* cited by examiner

INTERNAL COMBUSTION ENGINE AND OIL TREATMENT APPARATUS FOR USE WITH THE SAME

CROSS-REFERENCE TO RELATED PATENT APPLICATIONS

The present application is a continuation of U.S. patent application Ser. No. 16/416,733 filed May 20, 2019, which is a continuation of U.S. patent application Ser. No. 15/229,733 filed Aug. 5, 2016, which claims the benefit of U.S. Provisional Patent Application Ser. No. 62/205,156, filed Aug. 14, 2015; the entireties of which are incorporated herein by reference.

BACKGROUND

Splash-lubrication engines are generally known and widely used in small engines, such as those used in lawn mowers, outboard marine operation, lawn equipment, generators, power washers, snow blowers, and so on. In a splash lubrication engine, oil that gathers in the lower part of the crankcase, such as in the oil pan, oil tray, or other reservoir, is thrown upward as droplets (or fine mist) to provide lubrication to various parts of the engine, such as valve mechanisms, piston pins, cylinder walls, and piston rings. In one such typical splash-lubrication engine design, dippers on the connecting-rod bearing caps enter the oil trough located in the lower part of the crankcase and with each crankshaft revolution produces the oil splash. A passage may be drilled in each connecting rod from the dipper to the bearing to ensure lubrication. In certain instances, splash-lubrication engines may be lubricated through a combination of splash lubrication and force feeding. In certain such embodiment, an oil pump may keep the oil trough full so that the engine bearings can always splash enough oil onto the other parts of the engine.

Furthermore, gears in enclosed gear drives may also be splash lubricated. In this case, it is the tooth of the gear that is dipped in oil, which is then spread onto the teeth of the meshing gear as it turns.

Many splash-lubrication engines do not have an oil treatment system. As used herein, oil treatment includes oil filtration and/or replenishing oil with desired additives. Engine oil degrades because of accumulation of wear particles, fuel, moisture, and sludge. Also, oil additives are consumed—detergents, dispersants, corrosion inhibiters, and friction reducers. On splash lubricated engines, oil degradation is controlled by user maintenance—drain out the old oil, refill with new oil. Thus, oil treatment in splash-lubrication engines is desirable for obvious reasons. However, it has been generally thought that adding an oil treatment system to a splash-lubrication engine would require significant redesign of many castings, thereby resulting in a significant expenditure.

Additionally, new ways of treating oil in internal combustion engines having forced oil flow circulation is desired.

BRIEF SUMMARY

The present invention provides a solution to the aforementioned deficiencies of splash-lubrication engines and also introduces new methods and apparatus for treating oil in internal combustion engines, including both splash-lubrication engines and forced oil flow engines.

As will become apparent from the present disclosure, the inventive concepts discussed herein can be incorporated into existing splash-lubrication engine designs with minimal redesign. Furthermore, while the invention will be described herein with reference to a splash-lubrication engine, it is to be understood that the concepts disclosed herein can be utilized in engine types that include a forced flow oil filtration circuit. Moreover, the invention may be directed simply to the oil treatment apparatus itself or methods of treating oil without be limited to the engine itself and/or parts thereof. For example, it is envisioned that the invention can be directed to a sealed oil treatment apparatus that includes at least one of a filter media and/or an oil additive that can be easily inserted into an oil circulation circuit of an engine to treat the oil.

The present invention may provide a means to replenish oil additives, extend the oil change interval, and/or enhance engine longevity.

In one aspect, the invention can be a splash-lubrication internal combustion engine comprising: a crankcase comprising an oil sump containing an oil reservoir; a splash member positioned within the crankcase and configured to splash oil from the oil reservoir about the crankcase; an oil circulation circuit fluidly coupled to the oil reservoir; an oil filter apparatus operably coupled to the oil circulation circuit, the oil filter apparatus comprising a filter media; and a passive pump operably coupled to the oil circulation circuit and configured to flow oil from the oil reservoir filter through the oil circulation circuit.

In another aspect, the invention can be an internal combustion engine comprising: a crankcase comprising an oil sump containing an oil reservoir; a dipstick tube comprising a first passageway; an oil circulation circuit fluidly coupled to the oil reservoir, the first passageway of the dipstick tube forming a portion of the oil circulation circuit; an oil treatment apparatus operably coupled to the oil circulation circuit; and a pump operably coupled to the oil circulation circuit and configured to flow oil from the oil reservoir filter through the oil circulation circuit.

In yet another aspect, the invention can be an internal combustion engine comprising: a crankcase comprising an oil sump containing an oil reservoir; an oil circulation circuit fluidly coupled to the oil reservoir; and a pump operably coupled to the oil circulation circuit and configured to flow oil from the oil reservoir filter through the oil circulation circuit; and a mounting section comprising one or more protuberances configured to puncture a housing of an oil treatment apparatus when the oil treatment apparatus is mounted to the mounting section, thereby fluidly coupling the internal cavity of the oil treatment apparatus to the oil circulation circuit.

In still another aspect, the invention can be a method of treating oil in an internal combustion engine comprising: providing an oil treatment apparatus comprising a housing comprising a sealed internal cavity and at least one of a filter media or an oil additive disposed in the internal cavity of the housing; and mounting the oil treatment apparatus to a mounting section of the internal combustion engine, wherein during said mounting the housing of the oil treatment apparatus becomes punctured, thereby fluidly coupling the internal cavity of the oil treatment apparatus to an oil circulation circuit of the internal combustion engine.

In a further aspect, the invention can be an oil treatment apparatus comprising: a housing forming a sealed internal cavity; and a filter media disposed in the internal cavity; and an oil additive disposed in the internal cavity, the oil additive being in liquid form.

Further areas of applicability of the present invention will become apparent from the detailed description provided hereinafter. It should be understood that the detailed description and specific examples, while indicating an embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
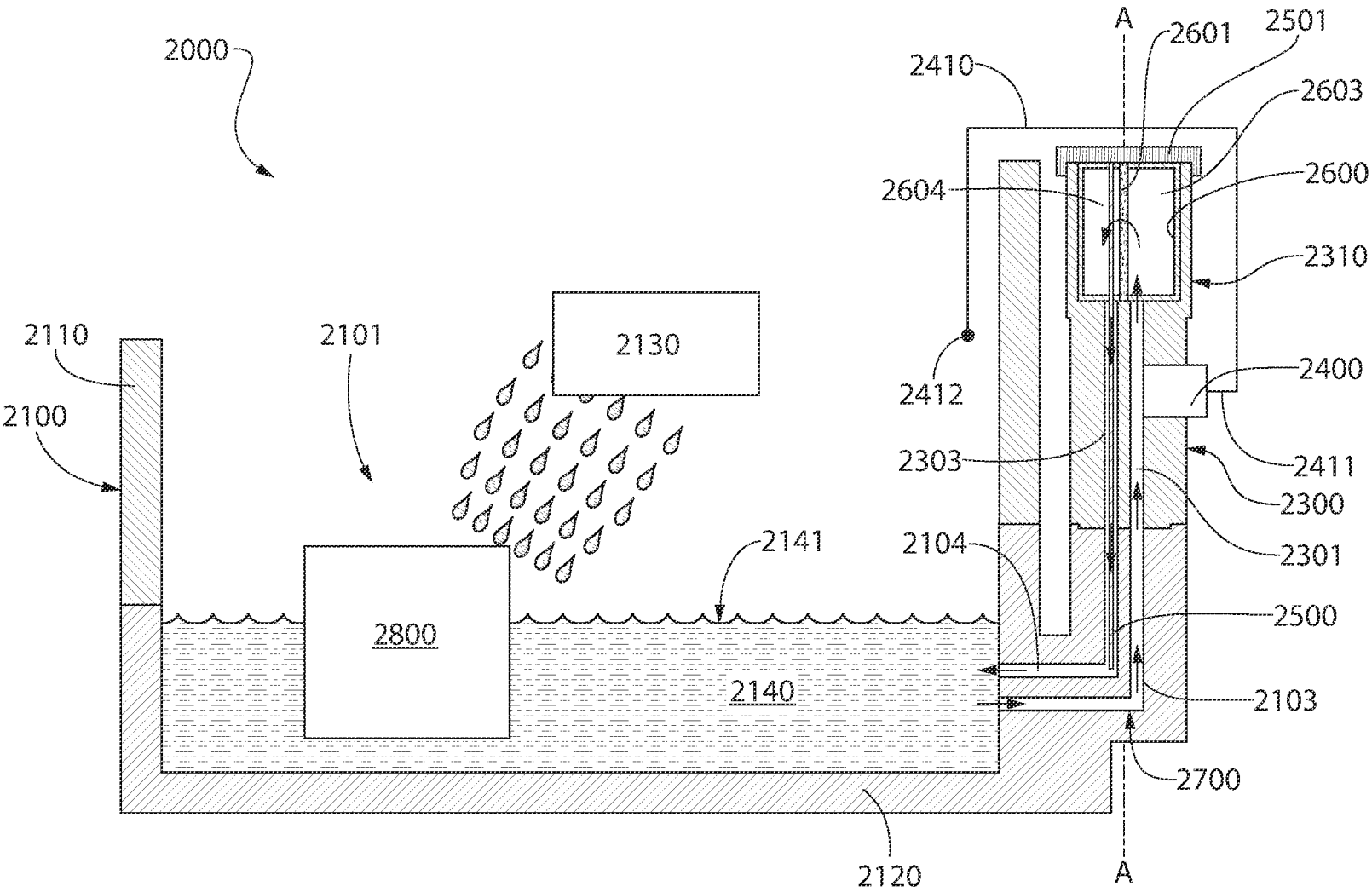
FIG. 1 is a schematic rendering of a portion of a splash-lubrication internal combustion engine according to the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "mounted" and similar refer to a relationship wherein structures are secured or attached to one another either directly or indirectly through intervening structures, as well as both movable or rigid attachments or relationships, unless expressly described otherwise.

Referring first to FIG. 1, a splash-lubrication engine 2000 according to the present invention is schematically illustrated. Unlike traditional splash-lubrication engines, the splash-lubrication engine 2000 includes an oil treatment system. The splash-lubrication engine 2000 is an internal combustion engine and generally comprises a crankcase 2100 defining an internal cavity 2101 (only a portion of the crankcase 2100 is illustrated herein for simplicity and ease of reference). The crankcase 2100 generally comprises a main crankcase body 2110 (which is the upper portion of the crankcase 2100) and an oil sump 2120 (which is the lower portion of the crankcase 2100). The oil sump 2120, which may be referred to as an oil pan or oil trough, forms a basin where engine oil gathers for splashing onto the components 2130 of the splash-lubrication engine 1000 that require lubrication. Engine oil that gathers in the oil sump 2120 is referred to herein as the oil reservoir 2140. The components 2130 to be lubricated (schematically illustrated in FIG. 1 as a box), may include, without limitation, the crankshaft, the walls of the crankcase, the crankshaft bearings, the connecting rod, the connecting rod bearings, the camshaft, the camshaft bearings, the cylinder block, the cylinder head, pistons, hydraulic valve lifters, and/or valve train components.

Splashing of oil from the oil reservoir 2140 about the internal cavity 2101 of the crankcase 2100 is effectuated by a splashing element 2800 (which is generically illustrated as a box in FIG. 1). The splashing element 2800 is positioned within the crankcase 2100 and configured to splash oil from the oil reservoir 2140 about the crankcase 2100. The splashing element 2800 may be positioned so that it is in contact (or periodically comes into contact during actuation) with oil from the oil reservoir when the splash-lubrication engine 2000 is operating under normal operating conditions. The splashing element 2800 can be any structure that is configured to splash oil about the crankcase 2100, such as paddles, dippers, slingers, gears, levers, etc. that are driven/actuated. One suitable specific example of a splashing element 2800 is a dipper that is attached to a connecting rod (or other structure), for example, in horizontal shaft engines. Another suitable specific example of a splashing element 2800 is a spinning gear with paddles (often referred to as a "slinger" in the art), for example, in vertical shaft engines.

For ease of discussion and to avoid clutter, many components of the splash-lubrication engine 2000 have been omitted from FIG. 1. For example, the splash-lubrication engine 2000 includes the necessary valve mechanisms, piston pins, cylinders, cylinder heads, cylinder walls, pistons, piston rings, combustion chamber, crankshaft, camshaft, dippers for splashing oil, connecting-rod bearing caps to which said dippers are connected, and other elements, as is known to those of skill in the art. In one embodiment, the splash-lubrication engine 2000 may be a single cylinder engine or may be a multi-cylinder engine. The splash-lubrication engine 2000 may be a horizontal shaft engine or a vertical shaft engine.

As mentioned above, the splash-lubrication engine 2000 comprises an oil treatment system. A used herein, the term "oil treatment" includes filtration of the engine oil, adding oil additives to the engine oil, or combinations of the two. As can be seen, the oil treatment system of the splash-lubrication engine 2000 generally comprises a modified dipstick tube 2300, a pump 2400, and an oil treatment apparatus 2600. The dipstick tube 2300, as illustrated, is a separate component that is coupled to the crankcase 2100. More specifically, as illustrated, the dipstick tube 2300 is coupled to the oil sump 2120. In other arrangements, the dipstick tube 2300 may be coupled to other portions of the crankcase 2100, or even other portions of the engine block. In still other arrangements, the dipstick tube 2300 may be integrally formed as part of the crankcase as a singular monolithic structure. The dipstick tube 2300 extends along a dipstick tube axis A-A.

As will be described in greater detail below, certain components of the splash-lubrication engine 2000 comprise passageways and chambers that collectively define an oil circulation circuit 2700 through which oil from the oil reservoir 2140 is drawn into, flowed through, and returned to the oil reservoir 2140. The flow of oil through the oil circulation circuit 2700 is schematically illustrated with dark arrows in FIG. 1. As can be seen, as the oil flows through the oil circulation circuit 2700, the oils flows through the oil treatment apparatus 2600. As exemplified, the oil treatment apparatus 2600 comprises a filter media 2601. Thus, as the oil flows through the oil circulation circuit 2700, the oil flows through the filter media 2601, thereby removing unwanted particulates and other undesirable contaminants from the oil. As discussed in greater detail below, however, the oil treatment apparatus 2600 may also comprise one or more oil additives instead of or in addition to the filter media 2601. The inclusion of oil additives in the oil treatment apparatus 2600, along with their mixing into the oil stream flowing through the oil circulation circuit 2700, will be described in greater detail below. When a filter media is included in the oil treatment apparatus 2600, the oil treatment apparatus 2600 may be referred to herein as an "oil filter apparatus"

In the exemplified embodiment, the oil treatment apparatus 2600 is mounted to the dipstick tube 2300. Thus, in this example, the dipstick tube 2300 comprises a mounting section 2310 that is configured to receive and support the oil treatment apparatus 2600. Structural details of one embodiment of the mounting section 2310 that is a part of the dipstick tube 2300 will be discussed in greater detail below with respect to FIGS. 2-8. In other arrangements of the invention, the oil treatment apparatus 2600 may be mounted at other locations on the splash-lubrication engine 2000, such as on an outer surface of the crankcase 2100. Thus, in such arrangements, the mounting section 2310 would be located elsewhere on the engine and may take on other structural arrangements, such as that will be described in relation to FIGS. 9A-B.

The pump 2400 is operably coupled to the oil circulation circuit 2700 to facilitate flow of the oil from the oil reservoir 2140, through the oil circulation circuit 2700 (including through the oil treatment apparatus 2600 along the way), and back into the oil reservoir 2140. In one embodiment, the pump 2400 may be an active pump, such as a rotary type pump that is driven by the rotation of the crankshaft or other mechanical linkage or drive train. In another embodiment, the pump 2400 is a passive pump. In one such arrangement of a passive pump, the pump 2400 may utilizes the vacuum/pressure within the crankcase 2100 to effectuate oil flow. One such suitable passive pump is a vacuum pulse pump. In embodiments where a vacuum pulse pump is utilized, a pump conduit 2410 may be provided. The pump conduit 2410 may have a first end 2411 fluidly coupled to an air chamber of the pump 2400 and a second end 2412 open to the internal cavity 2101 of the crankcase 2100. This allows the pressure within the air chamber to change/pulse in a corresponding manner with the pressure of the internal cavity 2101 of the crankcase 2100, thereby pulsing (flexing and releasing) a resilient diaphragm of the pump 2400 to force one-way oil flow through the oil chamber on the other side of the diaphragm. As can be seen, the second end 2412 of the pump conduit 2410 is located above an oil level 2141 of the oil reservoir 2140 when the internal combustion engine is under normal operating conditions. The exact specifications and sizing of such a vacuum pulse pump can be determined based on crankcase pressure measurements and viscosity data for the oil that is to be used in the splash-lubrication engine 2000.

In other embodiments, other types of passive pumps can be utilized. In one example, the passive pump may be a mechanism that creates a thermosiphon flow of the oil through the oil circulation circuit 2700. In such embodiments, the passive pump can be an appropriately placed cooling element heat exchange element, such as cooling fins or a coolant flow, that cools oil at an elevated location in the oil circulation circuit 2700 (such as at the oil treatment apparatus 2600), thereby allowing the cooled oil to fall back to the oil reservoir 2140 in the oil sump 2120 via the oil return passageways (identified below) of the oil circulation circuit 2700 while heated oil from the oil reservoir 2140 will naturally rise within the oil feed passageways (identified below) of the oil circulation circuit 2700.

In another example of a suitable passive pump, an inertia pump can be utilized that uses the engine vibration to move a piston mass along a tube section. The piston has a check valve. During use, oil is pushed to the oil treatment apparatus 2600 as the piston moves toward the oil treatment apparatus 2600, and flows thru the check valve when the piston moves away from the oil treatment apparatus 2600.

In a further example of a suitable passive pump, a magneto pump can be implemented. In such an embodiment, a ferromagnetic diaphragm can be utilized to create the pumping action (in a structural arrangement similar to a vacuum pulse ump). The ferromagnetic diaphragm, however, flexes and returns in response to the ignition magneto magnet, which may be located on the flywheel.

Referring still to FIG. 1, the pump 2400 is in operable and fluid communication with the oil circulation circuit 700 (and may conceptually be considered part of the oil circulation circuit 2700). As illustrated, the pump 2400 is mounted to the mounting section 2310, which is part of the dipstick tube 2300. However, as discussed above, in other embodiments, the mounting section 2310 may be located in other positons on the crankcase 2100 (or engine block) and, thus the pump 2400 will be mounted elsewhere (see FIGS. 9A-B for one non-limiting example).

In the exemplified arrangement, the oil circulation circuit 2700 is collectively defined by a feed passageway 2103 formed in the crankcase 2100, a feed passageway 2301 (also referred to as a second passageway herein in certain instances) formed in the dipstick tube 2300, a return passageway 2303 (also referred to as a first passageway herein in certain instances) formed in the dipstick tube 2300, and a return passageway 2104 formed in the crankcase 100. The return passageway 2303 of the dipstick tube 2300 is configured and sized to receive a dipstick 2500 (which is connected to a dipstick cap 2501). The dipstick 2500 extends through the oil treatment apparatus 2600 (discussed in greater detail below) and into the return passageway 2303 of the dipstick tube 2300 so that a user can check the oil level 2141 of the oil reservoir 2140. In other embodiments, however, the dipstick tube 2300 can be configured such that the dipstick 2500 extends into the feed passageway 2301 of the dipstick tube 2300.

During operation of the pump 2400, oil flows through the feed passageway 2301 of the dipstick tube 2300 in a first direction and oil flows through the return passageway 2303 of the dipstick tube 2300 in a second direction. The first direction of oil flow is opposite the second direction of oil flow. Additionally, the first direction of oil flow is substantially parallel to the dipstick tube axis A-A. As mentioned above, the oil treatment apparatus 2600 is mounted to the mounting section 2310 so that it is fluidly coupled to the oil circulation circuit 2700. In embodiments where the oil treatment apparatus 2600 comprises a filter media 2601 (as illustrated), the filter media 2601 may divide an internal cavity of the oil treatment apparatus 2600 into a feed chamber 2603 and a return chamber 2604. Thus, when such an oil treatment apparatus 2600 is fluidly coupled to the oil circulation circuit 2700, oil flowing through the oil circulation circuit 2700 must flow through the filter media 2601 to make its way through the oil circulation circuit 2700.

During operation of the splash-lubrication engine 2000, oil gathers in the oil reservoir 12140. The pump 2400 draws oil from the oil reservoir 2140 into the feed passageway 2103 of the crankcase 2100. Continued operation of the pump 2400 results in the oil then flowing through the second passageway 2301 of the dipstick tube 2300. The oil then exits the second passageway 2301 of the dipstick tube 2300 and enters the oil treatment apparatus 2600. As discussed in greater detail below with respect to FIGS. 3-9B, fluid coupling of the oil treatment apparatus 2600 to the oil circulation circuit 2700 may be effectuated by one or more protuberances that automatically pierce, cut, break, or otherwise puncture the housing of the oil treatment apparatus 2600 when the oil treatment apparatus 2600 is mounted to the mounting section 2310, thereby allowing oil to flow through the aperture(s) produced by the protuberance(s) into and/or or out of the oil treatment apparatus 2600. In other embodiments, the fluid coupling of the oil treatment apparatus 2600 to the oil circulation circuit 2700 can be accomplished by removing a seal of the oil treatment apparatus 2600 or by simply inserting a filter media 2600 at an in-line position of the oil circulation circuit 2700.

Once inside the oil treatment apparatus 2600, the oil is filtered as it passes through the filter media 2601. If the oil treatment apparatus 600 comprises an oil additive (not shown in FIG. 1), the oil additive mixes with the oil and becomes part of the oil stream. The oil (which may optionally include the oil additive at this time) then exits the oil treatment apparatus 600, flows into the first passageway 2303 of the dipstick tube 2300, and then into the return passageway 2104 of the crankcase 2100 and back into the oil reservoir 2140.

Figure 9A:
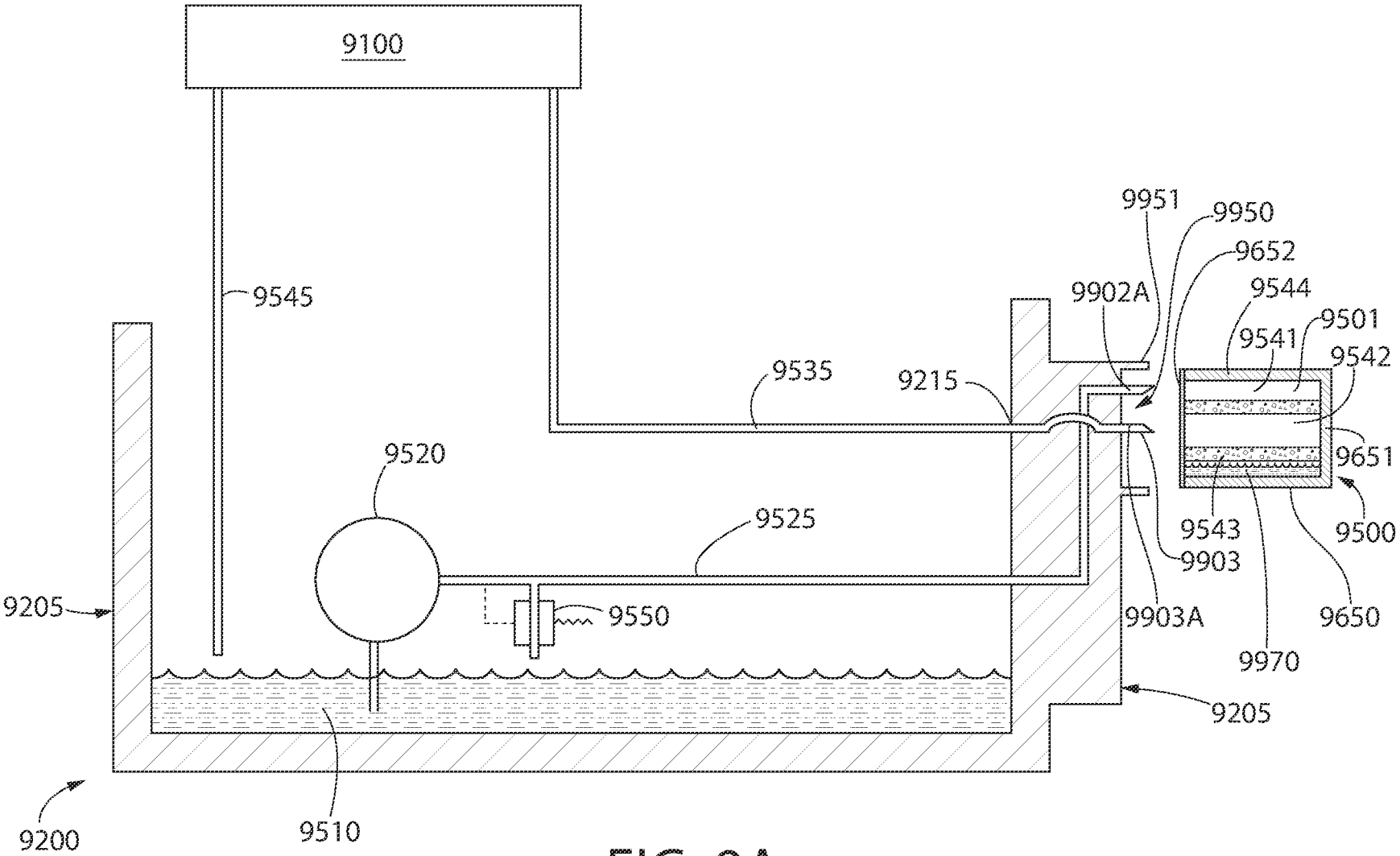
FIG. 9A is a schematic of a forced oil flow engine according to the present invention wherein the oil treatment apparatus is in an initial state in which the housing is sealed.
Figure 9B:
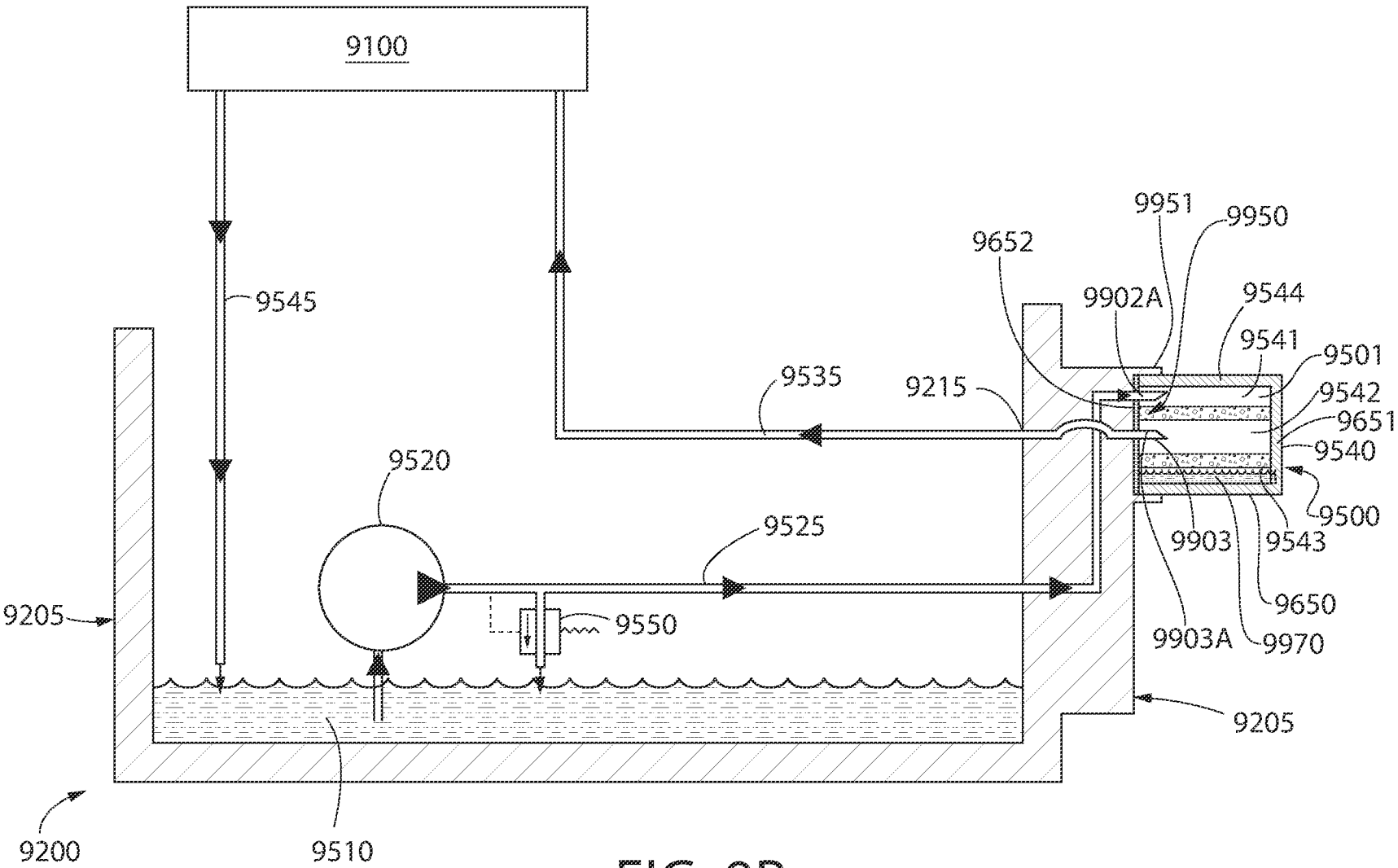
FIG. 9B is a schematic of the forced oil flow engine of FIG. 9B wherein the oil treatment apparatus is in an installed state in which the oil treatment apparatus is mounted to a mounting section and in fluid coupling with the oil circulation circuit.

Referring now to FIGS. 9A-9B concurrently, an internal combustion engine 9200 is schematically illustrated having a forced flow oil filtration circuit that provides oil to one or more components 9100 to be lubricated and/or cooled. The one or more components 9100 can be the same as those discussed above for the components 2130 of FIG. 1.

The internal combustion engine 9200 comprises, in fluid coupling, an oil reservoir 9510, an oil pump 9520, and the oil treatment apparatus 9500 (when in the installed state). The pump 9520 can be an active or passive pump. Additionally, in certain embodiments, an oil cooler may be provided. A pressure relief valve 9550 is also provided. The pressure relief valve 9550 is configured to be normally closed and to open at a predetermined pressure, thereby allowing oil to be dumped back into the oil reservoir 9510 without having to pass through the remainder of the oil circulation circuit 9700.

The oil circulation circuit 9700 generally comprises a feed passageway 9525 that delivers oil from the oil reservoir 9510 to an oil treatment apparatus 9500. The oil treatment apparatus 9500 is discussed in greater detail below and can include any of the details discussed above for the oil treatment apparatus 2600 of FIG. 1. The oil circulation circuit 9535 further comprises an return passageway 9535 that delivers oil leaving the oil treatment apparatus 2600 to the one or more components 9100, where said oil is then returned to the oil reservoir 9510 via the return passageway 9545 (or by simply dripping back into the oil reservoir 9510). In certain embodiments where the engine 9200 is a splash lubrication engine, the return passageway 9535 may deliver the oil leaving the oil treatment apparatus 2600 directly back into the oil reservoir 9510. The flow of the oil through the oil circulation circuit 9700 is schematically illustrated in FIG. 9B with dark arrows.

Of particular interest, the internal combustion engine 9200 is specifically designed to have a plurality of protuberances 9902, 9903 that automatically puncture a sealed housing 9544 of the oil treatment apparatus 9500 upon mounting of the oil treatment apparatus 9500 to the internal combustion engine 9200, thereby fluidly coupling the oil treatment apparatus 9500 to the oil circulation circuit 9700 of the internal combustion engine 9200. As can be seen, the plurality of protuberances 9902, 9903 are located on a mounting section 9950 of the internal combustion engine 9200. The mounting section 9950, in this embodiment, is located on the outer surface of the oil sump 9205. In other embodiments, however, the mounting section 9950 may be located on the main crankcase body (not shown), the dipstick tube (not shown), or any other suitable part of the engine block (or machine in which the internal combustion engine 9200 is installed).

In FIG. 9A, the oil treatment apparatus 9500 is not mounted to the mounting section 9950 and, thus, is in an initial state in which an internal cavity 9501 of the oil treatment apparatus 9500 is sealed by a housing 9544 of the oil treatment apparatus 9500. In FIG. 9B, the oil treatment apparatus 9500 is in installed state in which the plurality of protuberances 9902, 9903 have punctured the housing 9544, thereby fluidly coupling the internal cavity 9501 of the oil treatment apparatus 9500 to the oil circulation circuit 9700. The details of this mounting process, along with the associated structural details of the mounting section 9950 and the oil treatment apparatus 9500, will be described in greater detail below.

In addition to the plurality of protuberances 9902, 9903, the mounting section 9950 further comprises a mounting element 9951 that is configured to engage and/or retain the oil treatment apparatus 9500 in a desired position so that oil can be flowed therethrough. The exact structural manifestation of the mounting element 9951 will be dependent on the structural details of the oil treatment apparatus 9500 to which it is designed to receive (and vice-versa). For example, if the oil treatment apparatus 9500 was similar to a spin-on type filter, the mounting element 9951 may take the form of an annular collar having either a threaded outer surface and/or a threaded inner surface. In other embodiments, the mounting element 9951 may take the form of a clamp, latch, tab, prongs, overhang, undercut surface, depressions, combinations thereof and/or any structure that can adequately engage and retain the oil treatment apparatus

9500 in a desired position so that oil can be flowed through the oil treatment apparatus 9500.

In one embodiment, the plurality of protuberances 9902, 9903 are hollow structures that respectively comprises a passageway 9902A, 9903A extending therethrough through which oil can flow. However, in other arrangements, the plurality of protuberances 9902, 9903 can be solid structures that are designed to merely puncture the housing 9544 of the oil treatment apparatus 9500. A used herein, the term "puncture" includes any action by which the plurality of protuberances 9902, 9903 form an aperture in the housing 9544 due to contact and pressure, and covers such verbs such as tearing, piercing, ripping, rupturing, slicing, cutting, and the like.

In the illustrated embodiment, the plurality of protuberances 9902, 9903 comprises a feed protuberance 9902 having a feed passageway 9902 through which oil can flow into the internal cavity 9501 of the oil treatment apparatus 9500 and a return protuberance 9903 having a return passageway 9903A through which oil can exit the internal cavity 9501 of the oil treatment apparatus 9500. While only one of each of the feed and return protuberances 9902, 9903 are exemplified, it is to be understood that a plurality of feed protuberances 9902 and/or a plurality of feed protuberances 9903 can be implemented. Moreover, in other embodiments, only a single one of the protuberances 9902, 9903 can be provided, such as a single feed protuberance 9902 or a single return protuberance 9903. The exact requirement will be dictated by the structure of the oil treatment apparatus 9500 and other mechanisms that may be utilized to create fluid flow opening in the oil treatment apparatus 9500.

The housing 9544 of the oil treatment apparatus 9500 defines the internal cavity 9501. In the illustrated embodiment, the housing 9544 of the oil treatment apparatus 9500 comprises a structural body 9650, a lid 9651, and a floor 9652. Preferably, at least one of the floor 9652 and the lid 9651 is a foil, plastic film, combination thereof, or other suitably thin and/or weak material that allows the protuberances 9902, 9903 to puncture therethrough during a normal filter mounting procedure. In one embodiment, both of the floor 9652 and the lid 9651 are so constructed. The body 9650 of the housing 9544 may be formed of a sufficiently rigid material so as to maintain the structural integrity of the oil treatment apparatus 9500 so that the oil treatment apparatus 600 maintains its shape prior to installation, during installation, and during operation of engine 9200. In one embodiment, the body 9650 is a cylindrical shape but can take on other shapes.

In the illustrated embodiment, the oil treatment apparatus 9500 comprises both a filter media 9543 and an oil additive 9750 contained therein. However, as discussed above, either one of these may omitted. In one embodiment, the oil additive 9750 may be in liquid form. In other embodiments, the oil additive 9750 may be in the form of solids, gels, gases, liquids, or combinations thereof. Examples of oil additives 9750 include, without limitation detergents, dispersants, viscosity index improvers, anti-wear agents, antioxidants, friction modifiers, antifoam additives, metal deactivators, pour point depressants, seal swell agents, and rust and corrosion preventatives. In other embodiments, the oil additive can be in particulate, gel, powder, or other forms.

The filter media 9543 is disposed in the housing 9544 so as to divide the internal cavity 9501 of the oil treatment apparatus 9500 into an inlet chamber 9541 (which is an annular as illustrated) and an outlet chamber 9542 (which is a central chamber that is circumscribed by the inlet chamber 9541 as illustrated). When the oil treatment apparatus 9500 is mounted to the mounting the mounting section 9950 (thereby assuming the installed state): (1) the feed protuberance 9902 punctures the floor 9652 so that the feed passageway 9525 is fluidly coupled to the inlet chamber 9541 so that oil can be supplied to the oil treatment apparatus 9500; and (2) the return protuberance 9903 punctures the floor 9652 so that the return passageway 9535 is fluidly coupled to the outlet chamber 9542 so that oil can exit the oil treatment apparatus 9500 (after passing through the filter media 9543 and/or mixing with the oil additive 9970).

Figure 2:
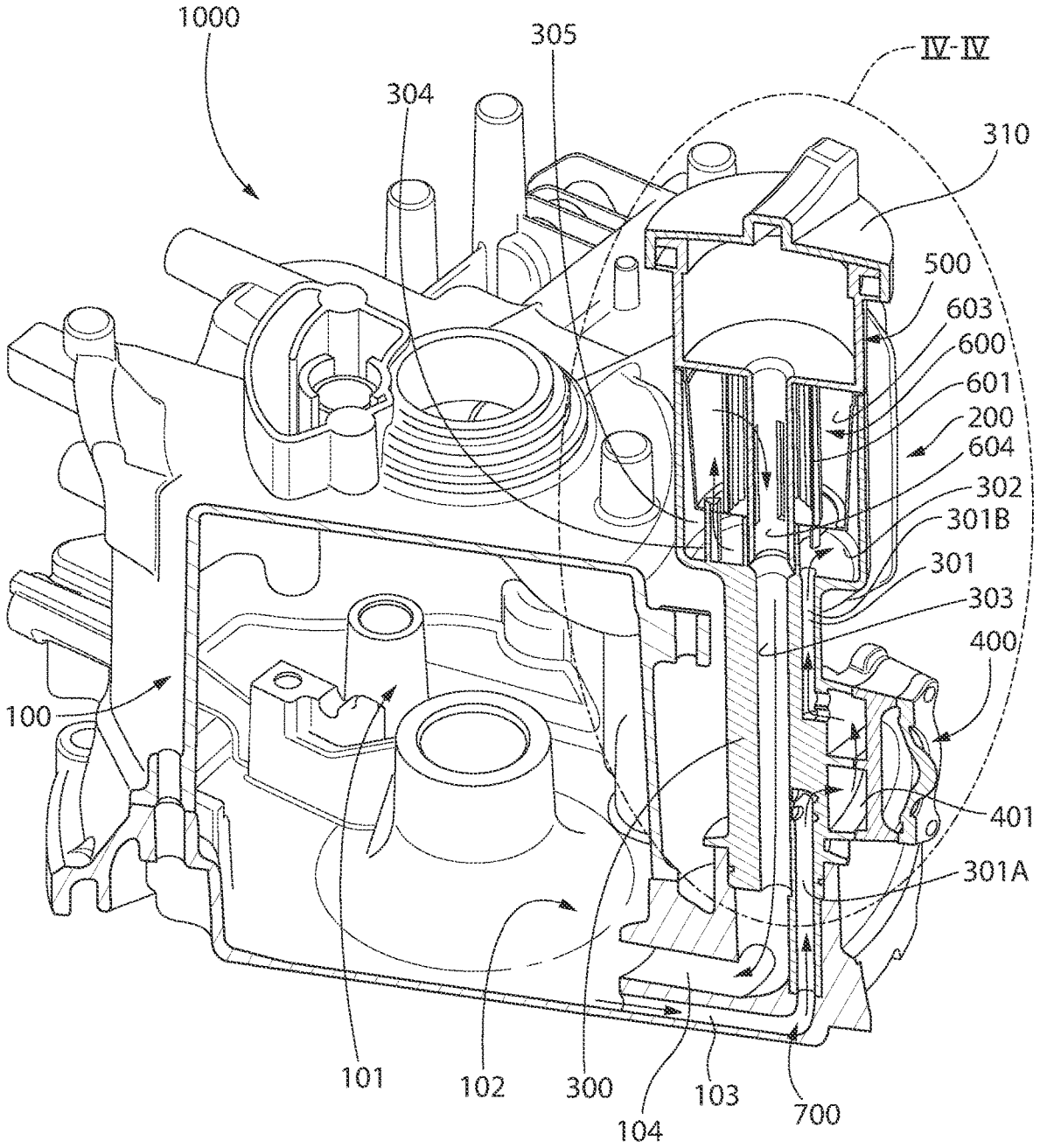
FIG. 2 is a top perspective view of a splash-lubrication engine according to the present invention, shown in a first partial cut-away.
Figure 3:
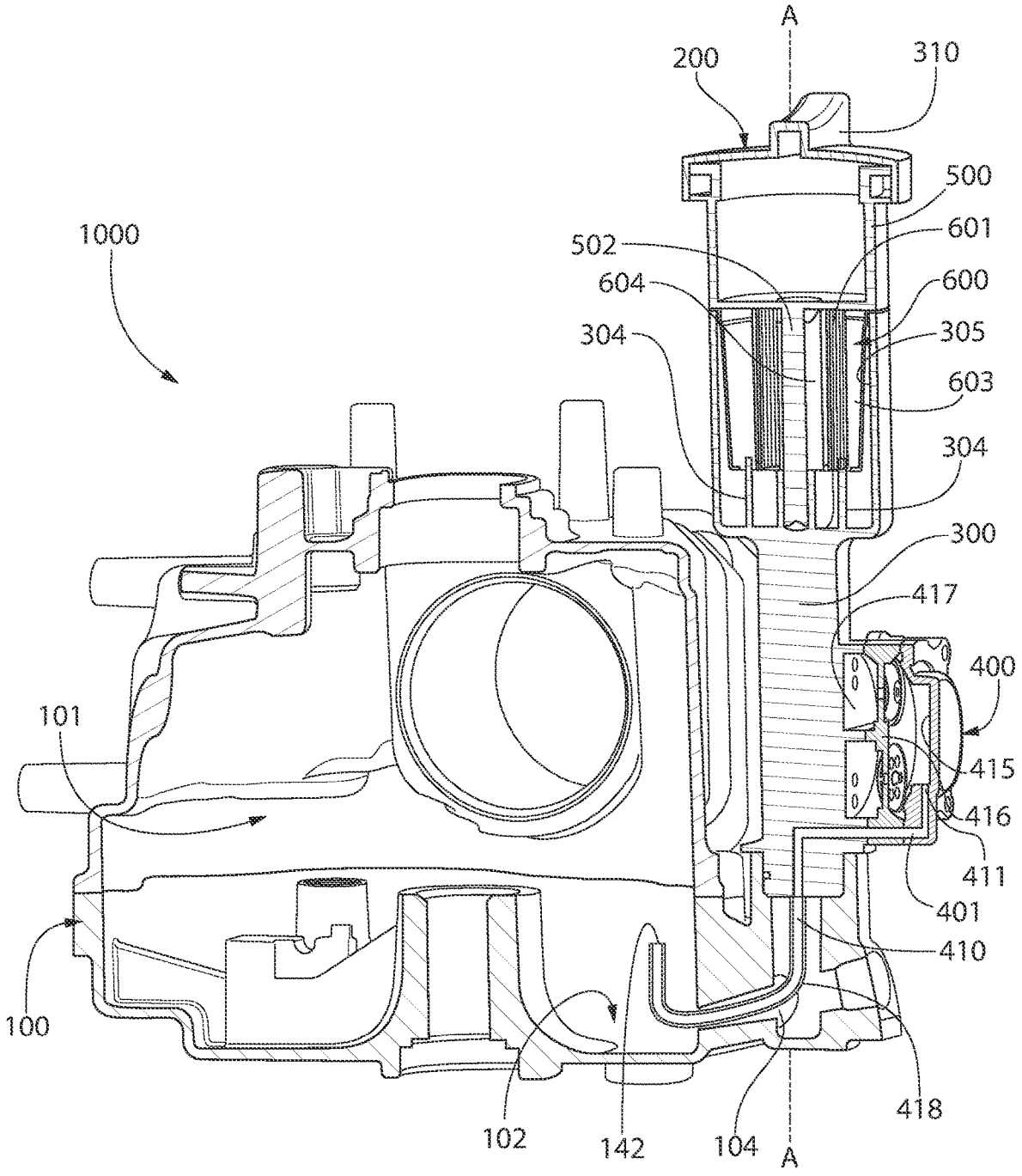
FIG. 3 is a side view of the splash-lubrication engine of FIG. 2, shown in a second partial cut-away.
Figure 4:
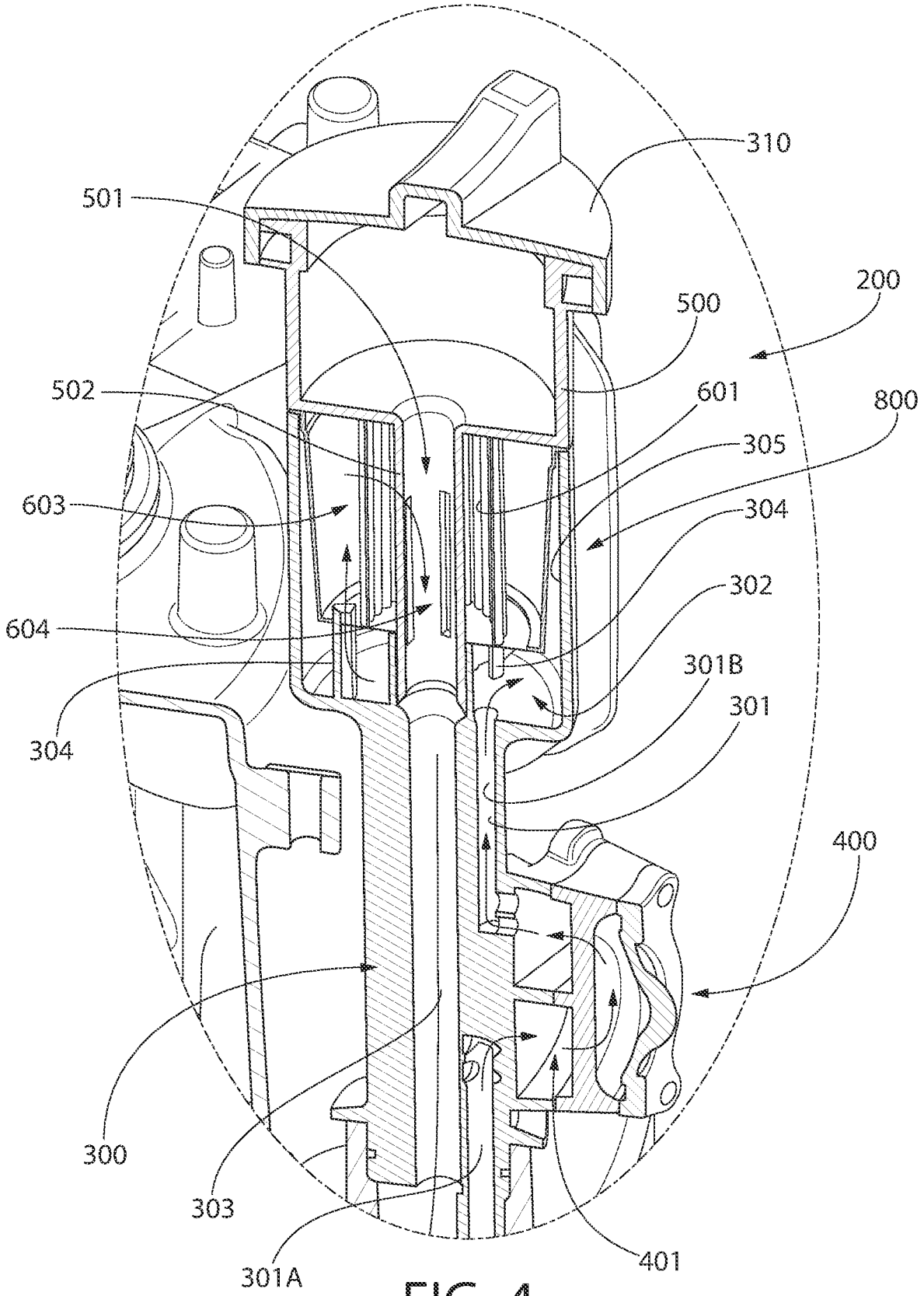
FIG. 4 is a close-up view of area IV-IV of FIG. 2.

Referring now to FIGS. 2-4 concurrently, a splash-lubrication engine 1000 having an oil treatment system incorporated therein is illustrated according to an embodiment of the present invention. The splash-lubrication engine 1000 exemplifies one structural embodiment of the invention that includes the various concepts discussed above with respect to FIGS. 1 and 9A-9B, such as: (1) utilizing a passageway of the dipstick tube as part of the oil circulation circuit; (2) the use of a passive pump in a splash lubrication engine to flow oil through a circulation circuit for treatment; (3) the mounting of a pump to the dipstick tube; (4) forming protuberances on the mounting section that are configured to puncture the housing of the oil treatment apparatus; and (5) a sealed oil treatment apparatus that includes both a filter media and an oil additive in liquid form. Of course, not all of these concepts need be utilized and any combination thereof can be used. Moreover, it should be understood that the details discussed above for engines 2100 and 9200 (and the components thereof) are applicable to the engine 1000 (and its components).

The splash-lubrication engine 1000 is an internal combustion engine and generally comprises a crankcase 100 defining an internal cavity 101. The crankcase 100 has an oil sump 102 that forms a trough where engine oil gathers for splashing onto the desired components (not shown) of the splash-lubrication engine 1000 that require lubrication. For ease of discussion and to avoid clutter, many components of the splash-lubrication engine 1000 have been omitted from the drawings. For example, the splash-lubrication engine 1000 includes the necessary valve mechanisms, piston pins, cylinders, cylinder heads, cylinder walls, pistons, piston rings, combustion chamber, crankshaft, camshaft, dippers for splashing oil, connecting-rod bearing caps to which said dippers are connected, and other elements, as is known to those of skill in the art.

It should be further noted that the splash-lubrication engine 1000 comprises a splashing element positioned within the internal cavity 101 of the crankcase 100 and configured to splash oil from the oil reservoir (i.e., the oil that gather in the oil sump 102 about the crankcase 100. The splashing element is positioned so that it is in contact (or periodically comes into contact during actuation) with oil from the oil reservoir when the splash-lubrication engine 1000 is operating under normal operating conditions. The splashing element can be any structure that is configured to splash oil about the crankcase, such as paddles, dippers, slingers, gears, levers, etc. that are driven/actuated, as is discussed above. The splashing element is omitted from the drawings of FIGS. 2-8 to avoid clutter and blocking view of other components of the engine.

Figure 7:
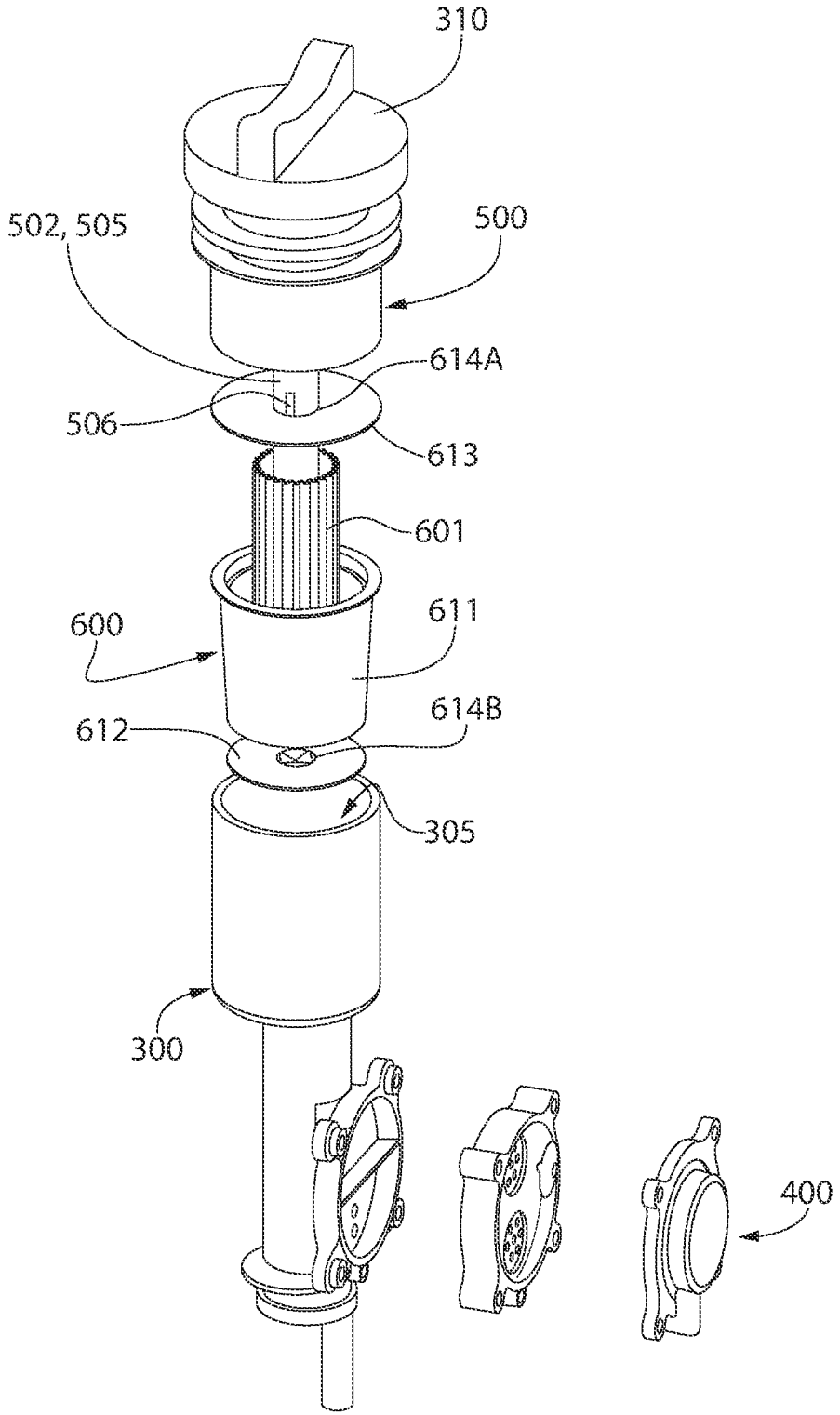
FIG. 7 is a perspective view of the splash-lubrication engine of FIG. 2 showing the oil treatment apparatus, the pump, the upper portion of the dipstick tube, and the retaining element in an exploded state.

The oil treatment system generally comprises a modified dipstick tube 300, a pump 400, a retaining element 500, and an oil treatment apparatus 600. As will be described in greater detail below, certain components of the oil treatment system 200 comprise passageways and chambers that collectively define an oil circulation circuit 700 through which oil gathering in the oil sump 102 is drawn into, flowed through, and returned to the oil sump 102. The flow of oil through the oil circulation circuit 700 is schematically illustrated in FIGS. 1-2 with dark arrows. As can be seen, as the oil flows through the oil circulation circuit 700, the oils flows through the oil treatment apparatus 600. As exemplified, the oil treatment apparatus 600 comprises a filter media 601. Thus, as the oil flows through the oil circulation circuit 700, the oils flows through the filter media 601, thereby removing unwanted particulates and other undesirable contaminants from the oil. As shown in FIG. 7, the oil treatment apparatus 600 may comprise one or more oil additives 602 instead of or in addition to the filter media 601. The inclusion of oil additives 602 in the oil treatment apparatus 600, along with their mixing into the oil stream flowing through the oil circulation circuit 700, will be described in greater detail below with respect to FIGS. 5 and 8.

The pump 400 is operably coupled to the oil circulation circuit 700 to facilitate flow of the oil from the oil sump 102, through the oil circulation circuit 700 (including through the filter media 601 of the oil treatment apparatus 600), and back into the oil sump 102. In one embodiment, the pump 400 is a passive pump that utilizes the vacuum/pressure within the crankcase 100 to effectuate oil flow. One such suitable passive pump is a vacuum pulse pump. The exact specifications and sizing of such a vacuum pulse pump can be determined based on crankcase pressure measurements and viscosity data for the oil that is to be used in the splash-lubrication engine 1000. In other embodiments, other types of pumps can be utilized. Other passive pumps can be sued as described above for FIG. 1. Additionally, the pump 400 may be an active pump in other arrangements.

As can be seen, the pump 400 is mounted to the dipstick tube 300 so as to be in operable and fluid communication with the oil circulation circuit 700. In other embodiments, the pump 400 may be located and/or mounted to a different portion of the splash-lubrication engine 1000, such as to the crankcase 100, as is discussed above.

In the exemplified arrangement, the oil circulation circuit 700 is collectively defined by the oil trough 102, a feed passageway 103 formed in the crankcase 100, a feed passageway 301 formed in the dipstick tube 300, a feed distribution chamber 302 formed in the dipstick tube 300, a return passageway 303 formed in the dipstick tube 300, and a return chamber 104 formed in the crankcase 100. The oil circulation circuit 700 may also include the oil flow passageways of the protuberances 304, 502 that puncture the oil treatment apparatus 600 (discussed below).

During operation of the splash-lubrication engine 1000, oil gathers in the oil sump 102. Due to the vacuum pressure pulses generated in the crankcase 100, the pump 400 draws oil from the oil trough 102 into the feed passageway 103 of the crankcase 100. A pump conduit 410 is provided (visible in FIG. 3). The pump conduit 410 has a first end 411 fluidly coupled to an air chamber 415 of the pump 400 and a second end 412 open to the internal cavity 101 of the crankcase 2100. This allows the pressure within the air chamber 415 to change/pulse in a corresponding manner with the pressure of the internal cavity 101 of the crankcase 100, thereby pulsing (flexing and releasing) a resilient diaphragm 416 of the pump 400 to force one-way oil flow through the oil chamber 417 on the other side of the diaphragm 416.

The second end 412 of the pump conduit 410 is located above an oil level of the oil reservoir residing in the oil sump 102 when the internal combustion engine is under normal operating conditions. As illustrated, the pump conduit 410 may comprise a section formed of a tube 418 that can fed through the feed passageway 104 and into the internal cavity 101 of the crankcase 100. The tube 418 comprises the second end 412 and may bent upward (similar to a snorkel) to be above the oil level. The exact specifications and sizing of such a vacuum pulse pump can be determined based on crankcase pressure measurements and viscosity data for the oil that is to be used in the splash-lubrication engine 1000.

Continued pulsing of the pump 400 results in the oil then flowing through a first section 301A of the feed passageway 301 of the dipstick tube 300, through the passageways 401 of the pump, and through a second section 301B of the feed passageway 303 of the dipstick tube 300. The oil then exits the second section 303B of the feed passageway 303 of the dipstick tube 300 and enters the feed distribution chamber 302 of the dipstick tube 300. The feed distribution chamber 302 of the dipstick tube 300 is an annular chamber that comprises a plurality of feed protuberances, which are in the form of inlet puncture members 304, that extend from a floor of the feed distribution chamber 302. As will be discussed in greater detail below, the inlet puncture members 304 puncture/penetrate a sealed housing of the oil treatment apparatus 600 when the oil treatment apparatus 600 is installed within a receiving chamber 305 of the dipstick tube 300, thereby allowing the oil to flow from the feed distribution chamber 302 into the inlet chamber 603 of the oil treatment apparatus 600. In the illustrated arrangement, the inlet puncture members 304 are arranged in a circumferential pattern.

If the oil treatment apparatus 600 comprises an oil additive 602 in the inlet chamber 603, the oil additive 602 mixes with the oil and becomes part of the oil stream. The oil (which may optionally include the oil additive 602 at this time) then passes through the filter media 601 and flows into the return chamber 604 of the oil treatment apparatus 600. As discussed in greater detail below, upon entering the return chamber 604 of the oil treatment apparatus 600, the oil may flow into a return passageway 501 formed in a return protuberance, which is in the form of an outlet puncture element 502 of the retainer 500. Either way, the oil then flows into the return passageway 303 of the dipstick tube 300, where it then flows through the return passageway 104 of the crankcase 100 and back into the oil trough 102.

It should be noted that the return passageway 303 of the dipstick tube 300 is sized to receive a dipstick (not shown) that is connected to the dipstick tube cap 310 for checking engine oil level. Additionally, while the dipstick tube cap 310 is exemplified as being a separate component than that of the retainer 500, the dipstick tube cap 310 and the retainer 500 may be formed as an integrated component. Moreover, the retainer 500 may be omitted in certain aspects of the invention and the dipstick itself can be used to puncture the sealed housing of the oil treatment apparatus 600 to create an oil outflow hole.

Figure 8:
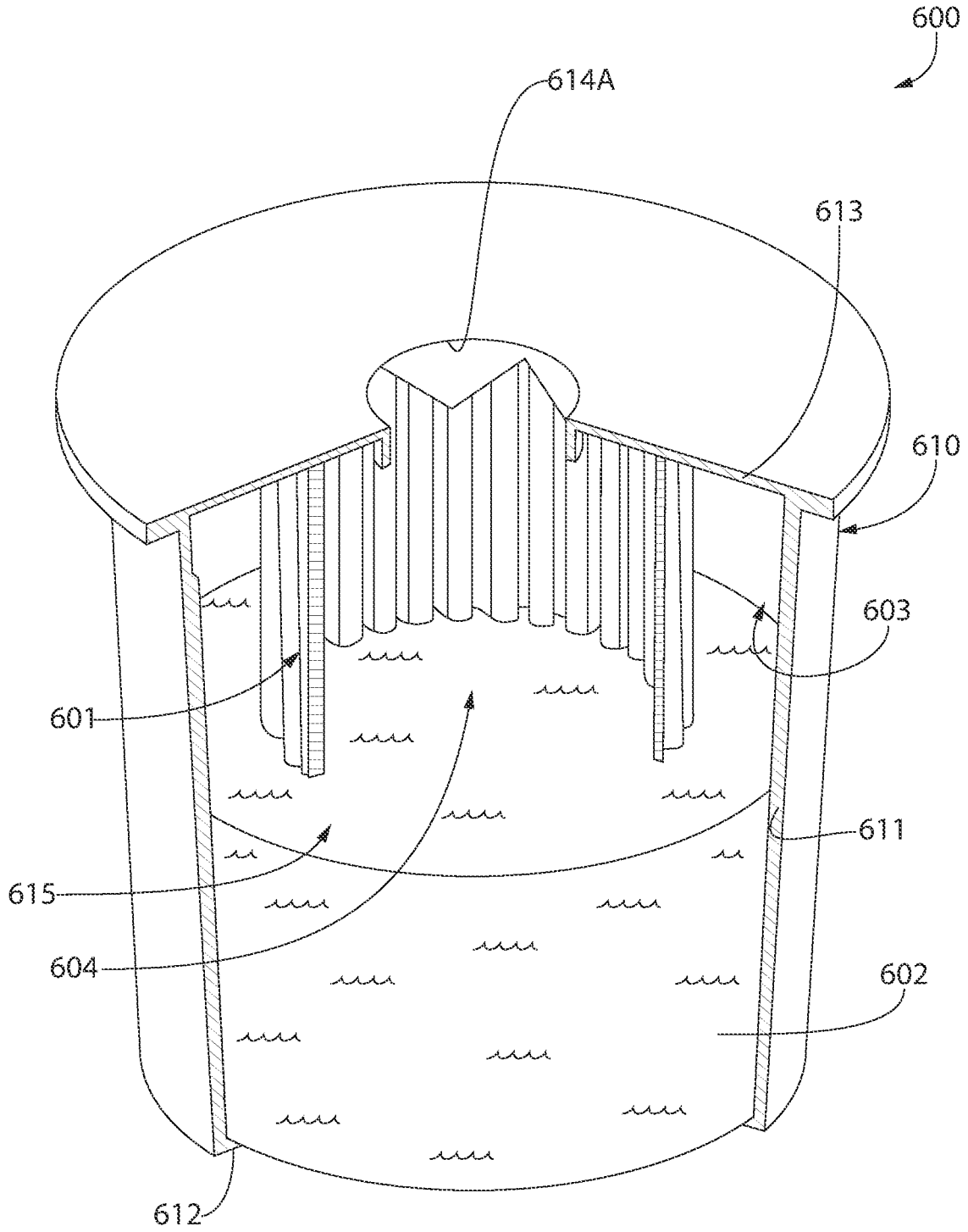
FIG. 8 is a perspective view of an oil treatment apparatus according to the present invention in partial cut-away.

Referring now to FIG. 8, the details of the exemplified oil treatment apparatus 600 will be discussed. The oil treatment apparatus 600 comprises a sealed housing 610 collectively formed by an outer annular wall 611, a floor 612, and a lid 613. It should be noted that in each of the drawings, puncture holes 614A-D have been formed in the floor 612 and the lid 613 of the oil treatment container 600 due to its installation into the oil treatment system 200 (discussed in greater detail below). However, prior to said installation, these puncture holes 614A-D are not present and, thus the housing 610 forms a sealed inner cavity 615 that is divided into the inlet chamber 603 and the outlet chamber 604 by the filter media 601, which is an annular structure. Because the inner cavity 615 of the oil treatment apparatus 600 is sealed, an oil additive 602, in liquid form, can be maintained within the inner cavity 615. Examples of oil additives 602 include, without limitation detergents, dispersants, viscosity index improvers, anti-wear agents, antioxidants, friction modifiers, antifoam additives, metal deactivators, pour point depressants, seal swell agents, and rust and corrosion preventatives. In other embodiments, the oil additive can be in particulate, gel, powder, or other forms.

In certain embodiments, the oil treatment apparatus 600 comprises both the filter media 601 and one or more oil additives 602. In another embodiment, the oil treatment apparatus 600 comprises the filter media 601 and the oil additives 602 are omitted. In yet another embodiment, the oil treatment apparatus 600 comprises the oil additives 60 and the filter media 601 is omitted.

The floor 612 and the lid 613 may be formed of a metal foil, plastic, or other puncturable material. The outer annular wall 611 may be formed of a sufficiently rigid material so as to maintain the structural integrity so that the oil treatment apparatus 600 maintains its shape prior to installation, during installation, and during operation of the oil treatment system 200 in the engine 1000.

Figure 5:
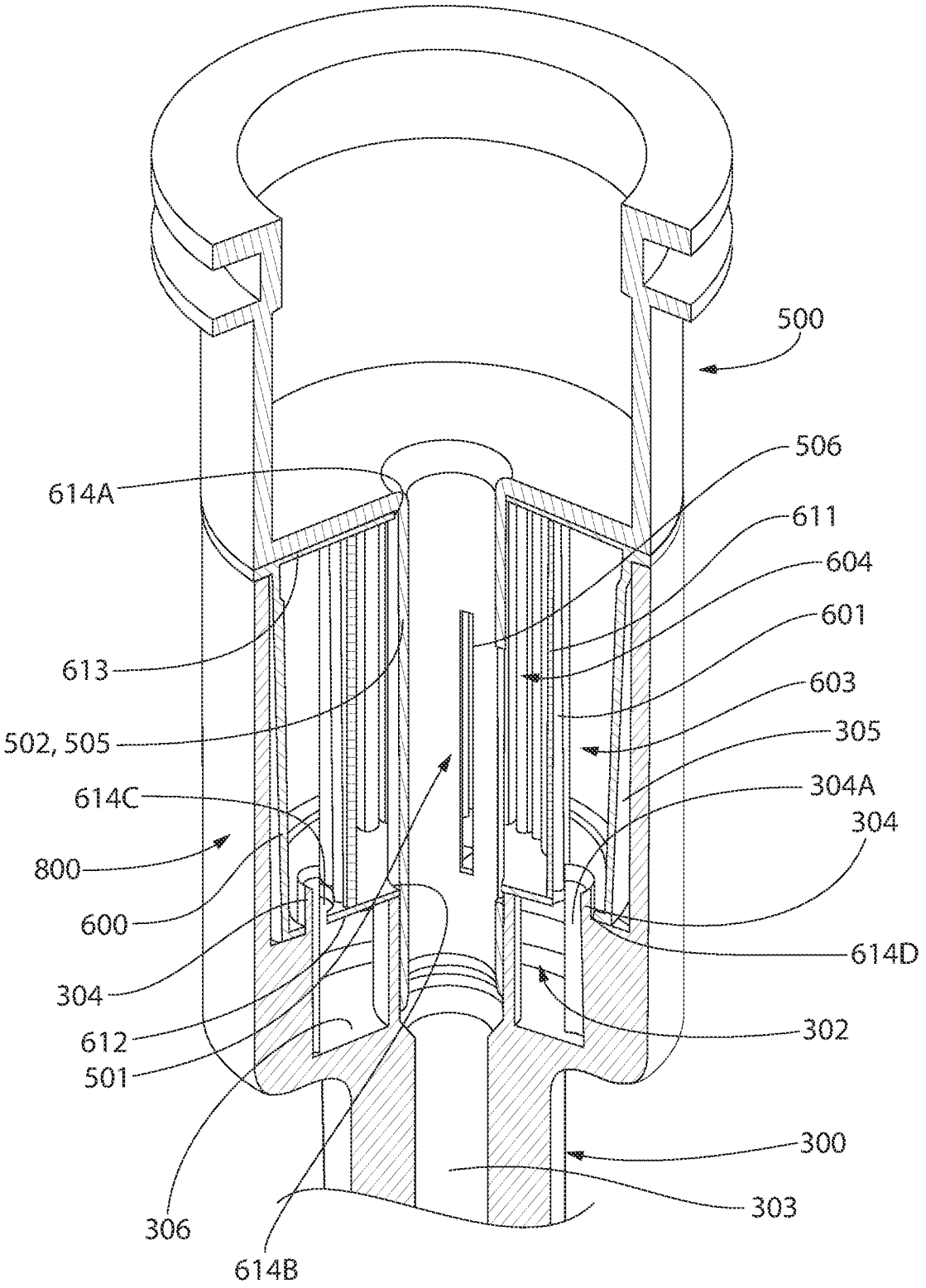
FIG. 5 is a perspective view of an oil treatment apparatus installed into the receiving chamber of the dipstick tube of the splash-lubrication engine of FIG. 2.
Figure 6:
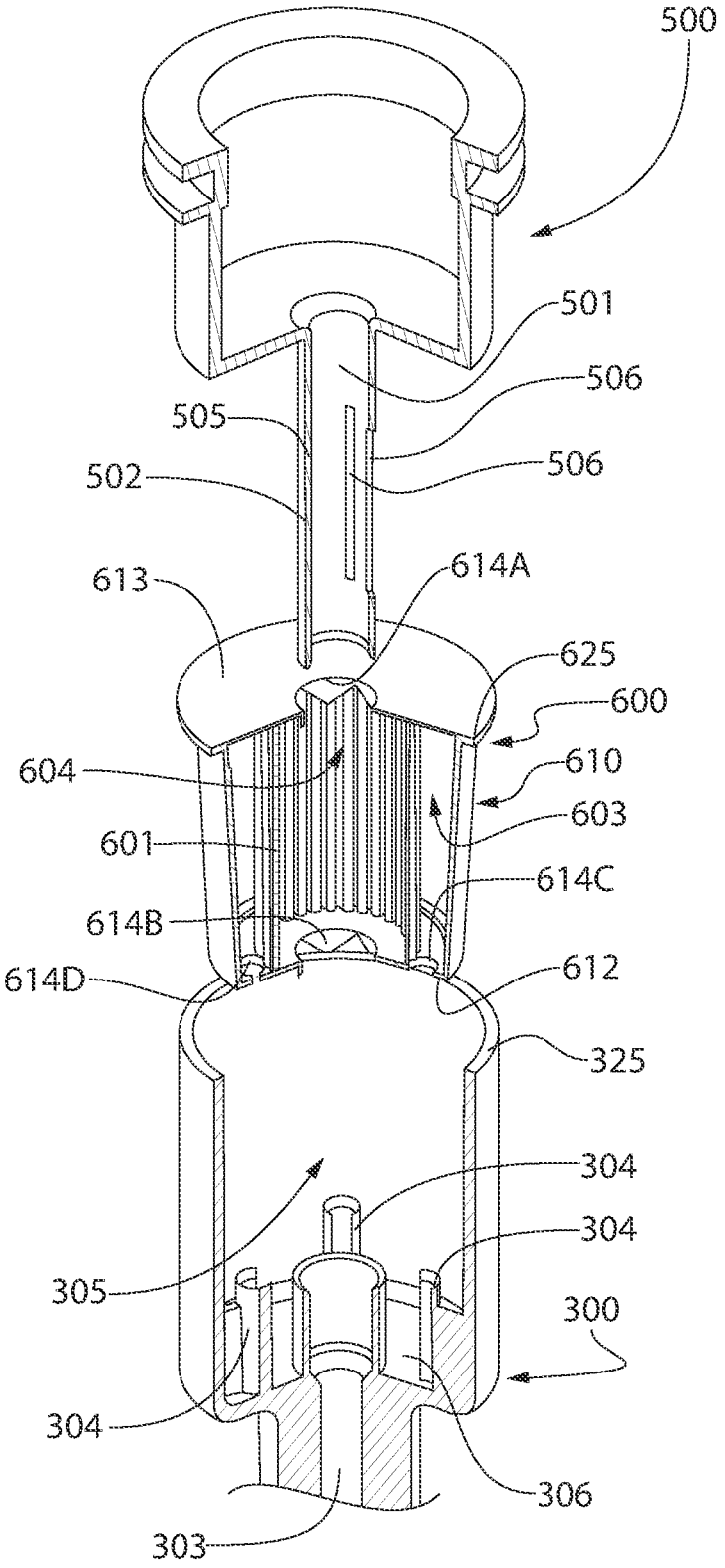
FIG. 6 is an exploded view of FIG. 5.

Referring now to FIGS. 5-7 concurrently, the installation of the exemplified oil treatment apparatus 600 into the oil circulation circuit 700 will be discussed. The dipstick tube 300 comprises a mounting section 800, which comprises a receiving chamber 305 that is sized and shaped to receive the oil treatment apparatus 600. As the oil treatment apparatus 600 is inserted into the receiving chamber 305, the feed puncture elements 304 (which protrude from a floor 306 of the receiving chamber) puncture the floor 613 of the housing 610 of the oil treatment apparatus 600, thereby forming puncture holes 614C-D in the floor 613 through which oil can flow. As exemplified, the feed puncture elements 304 are in the form of par-tubular structures that not only puncture the floor 613 to form the puncture holes 614C-D but also allow oil to flow through the puncture holes 614C-D while the feed puncture elements 304 remain extending through the puncture holes 614C-D. To accomplish this, each of the feed puncture elements 304 comprises a feed passageway 304A.

When the oil treatment apparatus 600 is fully inserted into the receiving chamber 305 of the dipstick tube, a flange 625 of the oil treatment apparatus 600 contacts an upper edge 325 of the dipstick tube 300, thereby seating the oil treatment apparatus 600 within the receiving chamber 305 such that the floor 613 of the oil treatment apparatus 600 is spaced from the floor 306 of the receiving chamber 305. As a result, the feed distribution chamber 302 is formed between the floor 613 of the oil treatment apparatus 600 and the floor 306 of the receiving chamber 305. The puncture holes 614C-D form passageways from the feed distribution chamber 302 to the feed chamber 603 of the oil treatment apparatus 600, thereby allowing oil to flow from the feed distribution chamber 302 to the feed chamber 603 of the oil treatment apparatus 600.

Once the oil treatment apparatus 600 is in the receiving cavity 305, the retainer 500 is aligned with the oil treatment apparatus 600 and inserted downward such that the return puncture element 502 of the retainer 500 punctures the lid 613 of the oil treatment apparatus 600, thereby forming the puncture hole 614A. The retainer 500 continues to be inserted downward until the return puncture element 502 of the retainer 500 also punctures the floor 612 of the oil treatment apparatus 600, thereby forming the puncture hole 614B. The puncture hole 614B forms a passageway from the return chamber 604 of the oil treatment apparatus 600 and the return passageway 303 of the dipstick tube 300 so that oil that has passed through the filter media 601 can return to the oil trough 102.

As can be seen, the return puncture element 502 of the retainer 500 is an open-ended tubular structure 505 that defines a return passageway 501. As such, the return puncture element 502 further comprises a plurality of apertures 506 formed into the tubular structure 505 that allow oil to pass into the return passageway 501 from the return chamber 604 of the oil treatment apparatus 600.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. An oil treatment system for an internal combustion engine comprising:

an elongated dipstick tube comprising a first flow passageway and a housing defining an internal cavity, a tube axis extending along the first flow passageway;

an oil treatment apparatus disposed in the internal cavity; and a retainer coupled to the housing, the retainer comprising an elongated first flow protuberance insertably received through the oil treatment apparatus and fluidly coupled to the first flow passageway of the dipstick tube.

2. The system according to claim 1, wherein the oil treatment apparatus is an oil filter having a cylindrical annular body comprising a filter media.

3. The system according to claim 2, wherein the first flow protuberance is a hollow tubular structure defining a second flow passageway in direct fluid communication with the first flow passageway of the dipstick tube.

4. The system according to claim 3, wherein the first flow protuberance is arranged coaxially along the tube axis of the dipstick tube and extends completely through the oil filter to the first flow passageway.

5. The system according to claim 4 wherein the first flow protuberance is insertably received inside an upper portion of the first flow passageway of the dipstick tube such that a direct coupling is formed between the first flow protuberance and the first flow passageway.

6. The system according to claim 3, when the second flow passageway defines an oil return chamber.

7. The system according to claim 6, further comprising an annular oil inlet chamber formed in the internal cavity of the housing between the oil filter and a sidewall of the housing.

8. The system according to claim 7, wherein the first flow protuberance includes a plurality of flow apertures arranged to establish fluid communication through the oil filter between the oil inlet chamber and the oil return chamber of the first flow protuberance.

9. The system according to claim 8, wherein the flow apertures comprise elongated slots formed through a cylindrical wall of the first flow protuberance.

10. The system according to claim 1, wherein the housing is a diametrically enlarged hollow tubular structure disposed on top of the dipstick tube and comprises a cylindrical sidewall which defines the internal cavity.

11. The system according to claim 10, wherein the housing has an open top and the oil treatment apparatus is insertable into the internal cavity before the retainer is coupled to the housing.

12. The system according to claim 11, wherein the retainer is mounted on top of the housing.

13. The system according to claim 12, wherein the retainer is a hollow tubular structure comprising a cylindrical sidewall defining a second cavity and a bottom wall, the first flow protuberance extending downwards from the bottom wall through the internal cavity of the housing to the first flow passageway of the dipstick tube.

14. The system according to claim 12, wherein the housing and retainer each have an outside diameter which is substantially the same such that exterior surfaces of the sidewalls of the housing and retainer are substantially flush with each other.

15. The system according to claim 13, further comprising a cap rotatably coupled to the retainer which encloses the second cavity of the retainer.

16. The system according to claim 7, wherein inserting the first flow protuberance of the retainer through the housing punctures both an upper frangible seal of the oil treatment apparatus defining a first puncture hole and a lower frangible seal of the oil treatment apparatus defining a second puncture hole.

17. The system according to claim 16, wherein the housing first comprises an oil feed distribution chamber and a plurality of upwardly extending oil second inlet flow protuberances which are fluidly coupled to the distribution chamber, the inlet flow protuberances puncturing the lower frangible seal to establish fluid communication between the oil feed distribution and the annular oil inlet chamber of the housing.

18. An oil treatment system for an internal combustion engine comprising:

a lower seal punctured by an inlet flow protuberance and a retainer flow protuberance and upper seal punctured by the retainer flow protuberance;

an elongated dipstick tube comprising a tubular body defining a first section of an oil return passageway fluidly coupled to an oil sump of the engine, and a diametrically enlarged cylindrical filter housing defining a first internal cavity;

an oil filter disposed in the first internal cavity, the oil filter having an annular body defining a central oil return chamber; and a tubular retainer coupled to the housing and defining a second internal cavity, the retainer comprising a hollow body including a cantilevered tubular oil return protuberance defining a second section of the oil return passageway;

the oil return protuberance extending through the oil filter to the dipstick tube such that the second section of the oil return passageway is directly fluidly coupled to the first section of the oil return passageway of the dipstick tube.

19. The system according to claim 18, wherein a distal end of the oil return protuberance is insertably received in the first section of the oil return passageway such that oil added to the second internal cavity of the retainer flows in a direct fluid path to through the oil return protuberance to the first section of the oil return passageway and to the oil sump of the engine.

20. A method for assembling an oil treatment system for an internal combustion engine comprising:

providing a dipstick tube including a first flow passageway fluidly coupled to an oil sump of the engine and an enlarged oil filter housing defining an upwardly open first cavity, and a tubular retainer defining a second internal cavity and including a cantilevered tubular flow protuberance defining a second flow passageway;

inserting an annular oil filter in the first cavity of the oil filter housing, the oil filter comprising a central chamber sealed at top and bottom ends by an upper seal and a lower seal respectively;

coupling the retainer to the oil filter housing;

inserting the flow protuberance of the retainer through the central chamber and the upper and lower seals; and coupling the flow protuberance to the dipstick tube to establish fluid communication between the second internal cavity of the retainer and the first flow passageway of the dipstick tube.

* * * * *